US008371417B2

(12) United States Patent
Miyazawa

(10) Patent No.: US 8,371,417 B2
(45) Date of Patent: Feb. 12, 2013

(54) HEADPHONES

(75) Inventor: Takayuki Miyazawa, Yokohama (JP)

(73) Assignee: JVC Kenwood Corporation, Yokohama-Shi, Kanagawa (JP)

( * ) Notice: Subject to any disclaimer, the term of this patent is extended or adjusted under 35 U.S.C. 154(b) by 0 days.

(21) Appl. No.: 13/182,935

(22) Filed: Jul. 14, 2011

(65) Prior Publication Data

US 2012/0018243 A1 Jan. 26, 2012

(30) Foreign Application Priority Data

Jul. 22, 2010 (JP) ..... 2010-164707

(51) Int. Cl.
*H04R 5/033* (2006.01)
*H04R 5/00* (2006.01)

(52) U.S. Cl. ..... 181/129; 381/371; 381/384

(58) Field of Classification Search ..... 181/129, 181/128; 381/370, 371, 374, 384, 380, 309
See application file for complete search history.

(56) References Cited

U.S. PATENT DOCUMENTS

| | | | | |
|---|---|---|---|---|
| 4,529,057 | A * | 7/1985 | Telford | 181/129 |
| 4,742,887 | A * | 5/1988 | Yamagishi | 181/129 |
| 4,981,194 | A * | 1/1991 | Kamon et al. | 181/129 |
| 5,581,821 | A * | 12/1996 | Nakano | 2/422 |
| 5,606,621 | A * | 2/1997 | Reiter et al. | 381/328 |
| 5,655,026 | A * | 8/1997 | Peters et al. | 381/385 |
| 5,867,582 | A * | 2/1999 | Nagayoshi | 381/370 |
| 6,307,943 | B1 * | 10/2001 | Yamagishi | 381/312 |
| 6,704,429 | B2 * | 3/2004 | Lin | 381/380 |
| 6,707,924 | B1 * | 3/2004 | Okiebisu | 381/385 |
| 6,731,956 | B2 * | 5/2004 | Hanna et al. | 455/569.1 |
| 6,920,228 | B2 * | 7/2005 | Redmer et al. | 381/370 |
| 7,120,268 | B2 * | 10/2006 | Murozaki et al. | 381/381 |
| 7,184,565 | B2 * | 2/2007 | Ohta | 381/384 |
| 7,457,428 | B2 * | 11/2008 | Vaudrey et al. | 381/372 |
| 7,489,795 | B2 * | 2/2009 | Ito | 381/381 |
| 7,616,772 | B2 * | 11/2009 | Sabick et al. | 381/374 |
| 7,822,220 | B2 * | 10/2010 | Kuo | 381/384 |
| 7,936,895 | B2 * | 5/2011 | Wang et al. | 381/374 |
| 8,032,191 | B2 * | 10/2011 | Yang | 455/575.2 |
| 2004/0032965 | A1 * | 2/2004 | Ito | 381/381 |
| 2007/0041605 | A1 * | 2/2007 | Yang | 381/370 |
| 2008/0089544 | A1 * | 4/2008 | Ito | 381/370 |
| 2009/0092269 | A1 * | 4/2009 | Nielsen et al. | 381/313 |
| 2009/0136074 | A1 * | 5/2009 | Chang et al. | 381/380 |
| 2010/0104126 | A1 * | 4/2010 | Greene | 381/384 |
| 2011/0110543 | A1 * | 5/2011 | Ishizaka et al. | 381/309 |
| 2012/0076340 | A1 * | 3/2012 | Uchida et al. | 381/370 |

FOREIGN PATENT DOCUMENTS

JP 07-288887 10/1995

* cited by examiner

*Primary Examiner* — Edgardo San Martin
(74) *Attorney, Agent, or Firm* — Renner, Kenner, Greive, Bobak, Taylor & Weber

(57) ABSTRACT

In a headphone set, a speaker is enclosed in a housing. A cord is connected to the speaker at one end and running to the outside of the housing at another end through a pulling-out portion of the housing. The cord is inserted into a bushing at the pulling-out portion. An outer-shape expansion portion is fixed to the cord and located between the speaker and the bushing. The outer-shape expansion portion expands the outer shape of the cord. A concavity is provided to the bushing at one end of the bushing closer to the speaker. At least a portion of the outer-shape expansion portion is put in the concavity.

4 Claims, 9 Drawing Sheets

HEADPHONES

CROSS-REFERENCE TO RELATED APPLICATIONS

This application is based on and claims the benefit of priority from the prior Japanese Patent Application No. 2010-164707 filed on Jul. 22 2010, the entire contents of which are incorporated herein by reference.

BACKGROUND OF THE INVENTION

The present invention relates to headphones.

In headphones, one end of a cord is connected to a speaker unit and the other end thereof runs to the outside of a housing through a flexible bushing. The cord is provided with an outer-shape expansion portion (such as a knot tied in the cord) located inside the housing.

Such structure is applied to a variety of headphones, such as, an overhead type having a head band to be supported on the head, and an inner-ear type to be inserted into the auricle.

With this structure, the cord is protected from being detached from the housing because of a larger size of the knot, the outer-shape expansion portion, than the other portion of the cord. Moreover, the cord exhibits high durability because it runs to the outside of the housing through the flexible bushing.

The outer-shape expansion portion (the knot) is provided between the bushing and the speaker unit in the housing.

When the outer-shape expansion portion is located closer to the bushing, the length of the cord to be pulled from outside becomes shorter, thus exhibiting high quality.

Moreover, the outer-shape expansion portion protects an end of the cord soldered to the speaker unit from external force, thus also exhibiting high quality.

Therefore, the outer-shape expansion portion requires to be installed in the housing and located closer to the bushing.

It is preferable for the speaker unit to be larger for outputting sounds of higher quality. A larger speaker unit is equipped with a larger diaphragm, a larger magnet, etc.

However, there is a demand for more compact headphones with a smaller housing, for use in, particularly, outdoors.

Therefore, the housing requires the space enough for installing a large speaker unit and a knot of a cord, hence posing a difficulty in compactness of headphones.

SUMMARY OF THE INVENTION

A purpose of the present invention is to provide a headphone set having a compact housing with a cord having an outer-shape expansion portion provided in the housing, the cord being protected from being detached from a bushing and exhibiting high durability.

The present invention provides a headphone set comprising: a housing having a pulling-out portion; a speaker enclosed in the housing; a cord having a first end and an opposing second end, the first end being connected to the speaker, the second end being running to the outside of the housing through the pulling-out portion; a bushing formed into a tube having a first through hole, the bushing supporting the cord in a way that the cord is inserted into the first through hole at the pulling-out portion; an outer-shape expansion portion fixed to the cord and located between the speaker and the bushing, the outer-shape expansion portion expanding the outer shape of the cord; and a concavity provided to the bushing at one end of the bushing closer to the speaker, at least a portion of the outer-shape expansion portion being put in the concavity.

DETAILED DESCRIPTION OF PREFERRED EMBODIMENT

A preferred embodiment according to the present invention will be described with reference to FIGS. 1 to 9.

Figure 1:
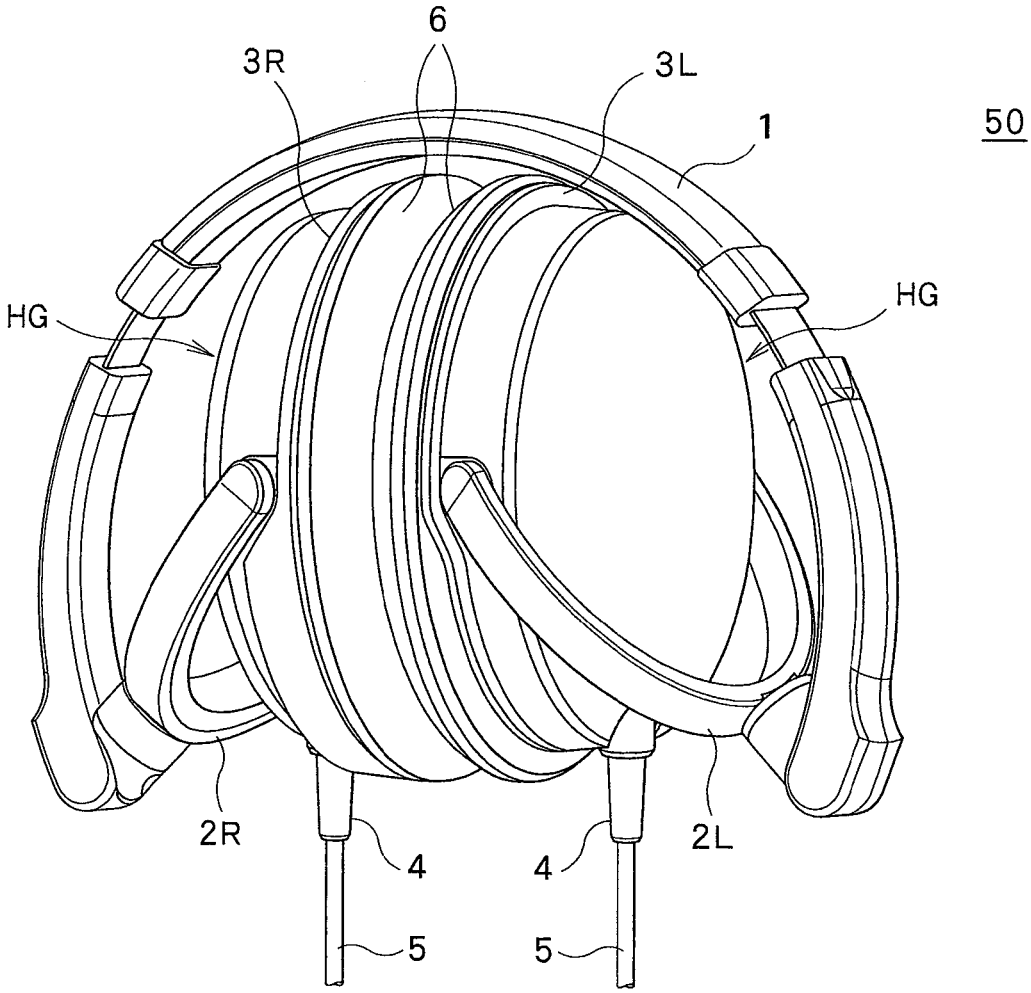
FIG. 1 is a perspective view of the appearance of a headphone set, an embodiment according to the present invention.

FIG. 1 is a perspective view of the appearance of a headphone set 50, an embodiment according to the present invention.

The headphone set 50 is an overhead type, equipped with a head band 1, roughly-U-shaped hangers 2L and 2R connected to both ends of the head band 1, and main units 3L and 3R supported by the hangers 2L and 2R, respectively.

The headphone set 50 has two modes: a used mode and a non-used mode in which the headphone set 50 is folded. FIG. 1 shows the non-used mode.

A cord 5 is running from each of the main units 3L and 3R, through a bushing 4. The position from which the cord 5 is running is indicated with a cord-running section HD in FIG. 2. An ear pad 6 is detachably attached to each of the main units 3L and 3R.

The main unit 3L will be explained next. The main unit 3L for the left ear and the main unit 3R for the right ear have a shape of almost plane symmetry. The explanation of the main unit 3R is thus omitted.

Figure 2:
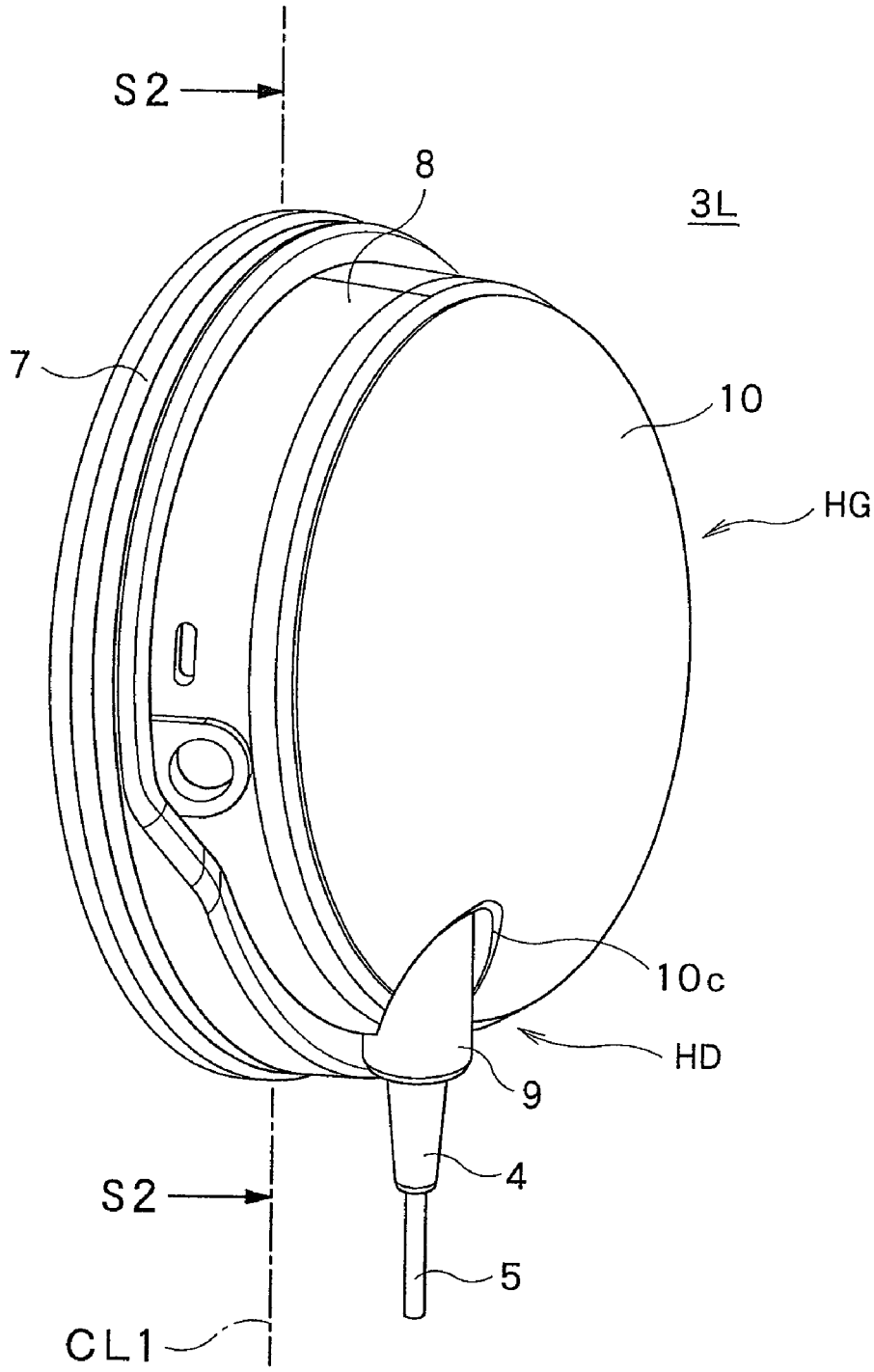
FIG. 2 is a perspective view of the appearance of a main unit of the headphone set, the embodiment according to the present invention.
Figure 3:
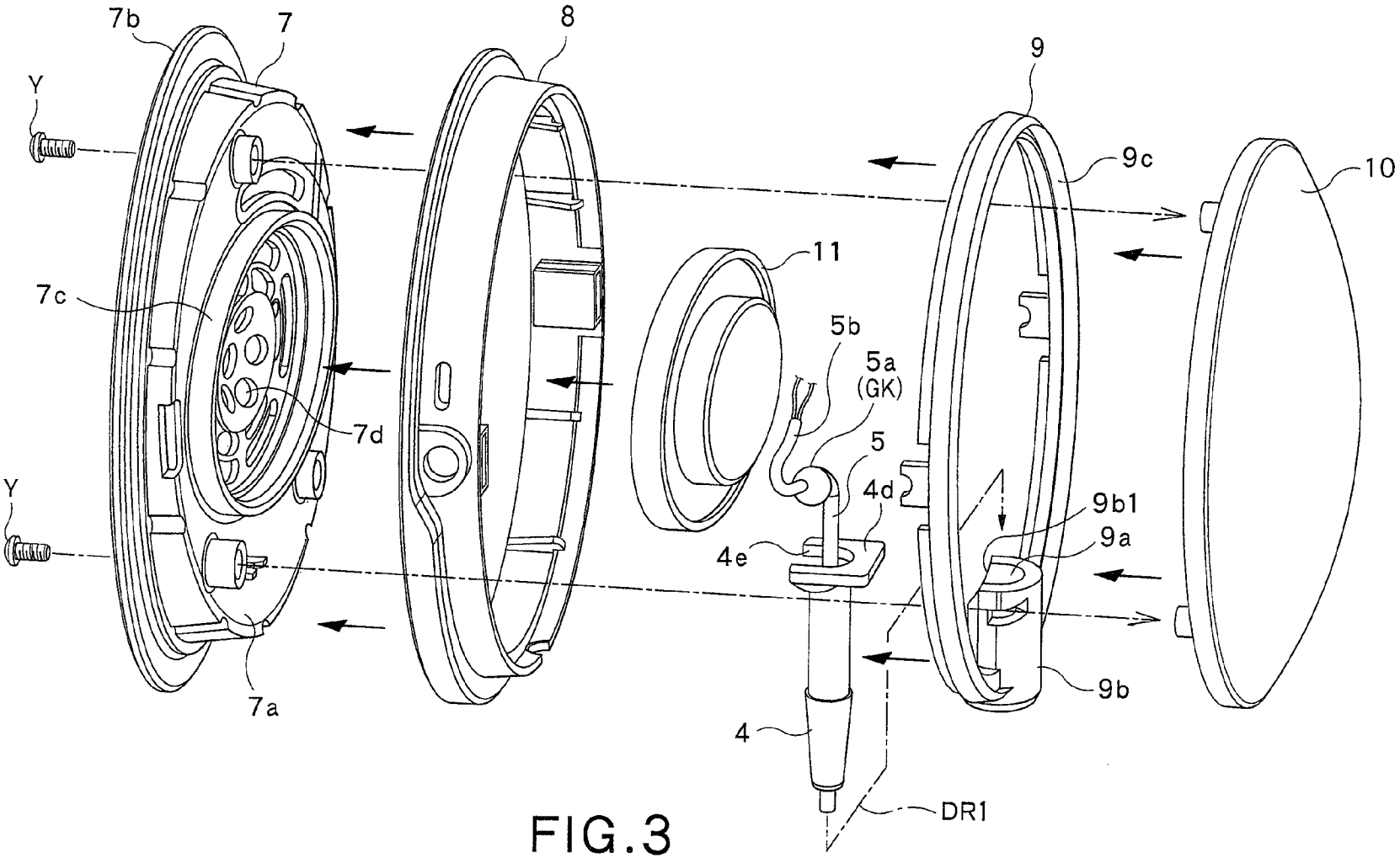
FIG. 3 is an exploded view of the main unit shown in FIG. 2.

FIG. 2 is a perspective view of the appearance of the main unit 3L, without the ear pad 6 (detached therefrom). FIG. 3 is an exploded view of the main unit 3L shown in FIG. 2.

As shown in FIGS. 2 and 3, the main unit 3L has a base 7, a ring base 8, an ornament ring 9, and a cover 10. Moreover, the main unit 3L has a speaker unit 11 attached to the base 7 and a cylindrical bushing 4 attached to the ornament ring 9. A cord 5 is inserted into the bushing 4.

A case that consists of the base 7, the ring base 8, the ornament ring 9, and the cover 10 is referred to as a housing HG, hereinafter, as shown in FIG. 2.

The speaker unit 11 is installed in the housing HG and the bushing 4 is exposed to the outside of the housing HG.

The base 7 has an oval baffle board 7*a* having a longitudinal axis CL1 (FIG. 2), an annular flange 7*b* connected to the edge of the baffle board 7*a* and protruding outwardly in the direction of diameter for the ear pad 6 to be attached thereto, an annual rib 7*c* that stands on the baffle board 7*a*, and a plurality of sound output holes 7*d* provided on the baffle board 7*a* and surrounded by the rib 7*c*. The surface of the baffle board 7*a* is inclined to the plane including the flange 7*b* by a predetermined angle.

The ring base 8 is a roughly oval ring that corresponds to the shape of the base 7 so that the former can be attached to the latter to surround the baffle board 7*a*.

The speaker unit 11 is fixed to the base 7 by an adhesive so as to be placed inside the rib 7*c* of the base 7. The sounds emitted by the speaker unit 11 are given off to the outside through the sound output holes 7*d*.

The ornament ring 9 will be explained with reference to FIG. 3 and FIG. 4 that is a three-view drawing.

The ornament ring 9 has a tube 9*b* having a through hole 9*a* (a pulling-out portion for the cord 5) and an oval ring 9*c* that corresponds to the outer shape of the base 7 and the ring base 8.

The bushing 4 will be explained with reference to FIG. 3 and FIG. 5 that is a three-view drawing.

The bushing 4 has a tube 4*b* having a through hole 4*a*, a tapered tube 4*c* connected to one end of the tube 4*b*, and a rectangular flange 4*d* formed at the other end of the tube 4*b*. A concavity 4*e* is formed at the other end of the tube 4*b*, that is curved in the flange 4*d*.

As shown in FIG. 3, the bushing 4 is inserted into the through hole 9*a* of the ornament ring 9 from the top of the tapered tube 4*c* of the bushing 4 in a direction of an arrow DR1. The cord 5 is then inserted into the through hole 4*a* of the bushing 4 so that the cord 5 is supported by the bushing 4.

Illustrated in FIG. 3 is that the cord 5 has been inserted into the through hole 4*a* of the bushing 4 before the bushing 4 is inserted into the through hole 9*a* of the ornament ring 9.

As shown in FIG. 3, the cord 5 is provided with an outer-shape expansion portion GK that expands the outer shape of the cord 5. In this embodiment, the outer-shape expansion portion GK is a knot 5*a*. The knot 5*a* has a larger size than the smallest diameter of the through hole 4*a* of the bushing 4 so that the knot 5*a* cannot be inserted into the through hole 4*a*. Therefore, the outer-shape expansion portion GK (the knot 5*a*) prevents the cord 5 from being detached from the bushing 4.

Figure 5:
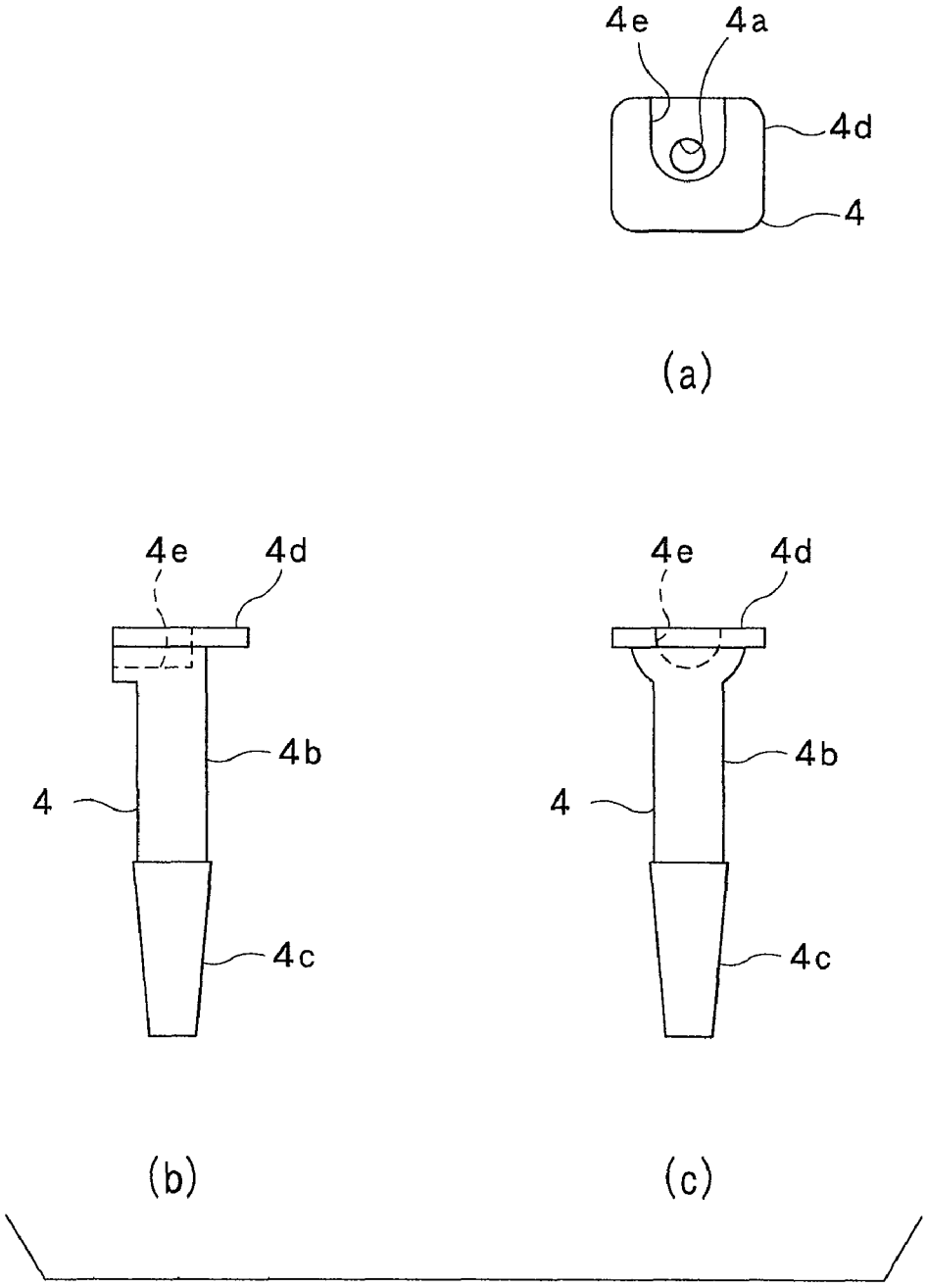
FIG. 5 is a three-view drawing that illustrates another component of the main unit.

The covering of the cord 5 is stripped away at one end 5*b* (referred to as a cord end 5*b*, hereinafter) thereof so that core wires are exposed, as shown in FIG. 5. The core wires are electrically connected to terminals (not shown) of the speaker unit 11.

The ornament ring 9 is fit into the ring base 8, with the bushing 4 having been inserted into the tube 9*b*. The ornament ring 9 may be fixed to the ring base 8 by an adhesive.

The cover 10 has a bowl shape with an oval circumference corresponding to the ornament ring 9. The cover 10 is fit into the ring 9*c* of the ornament ring 9.

Figure 7:
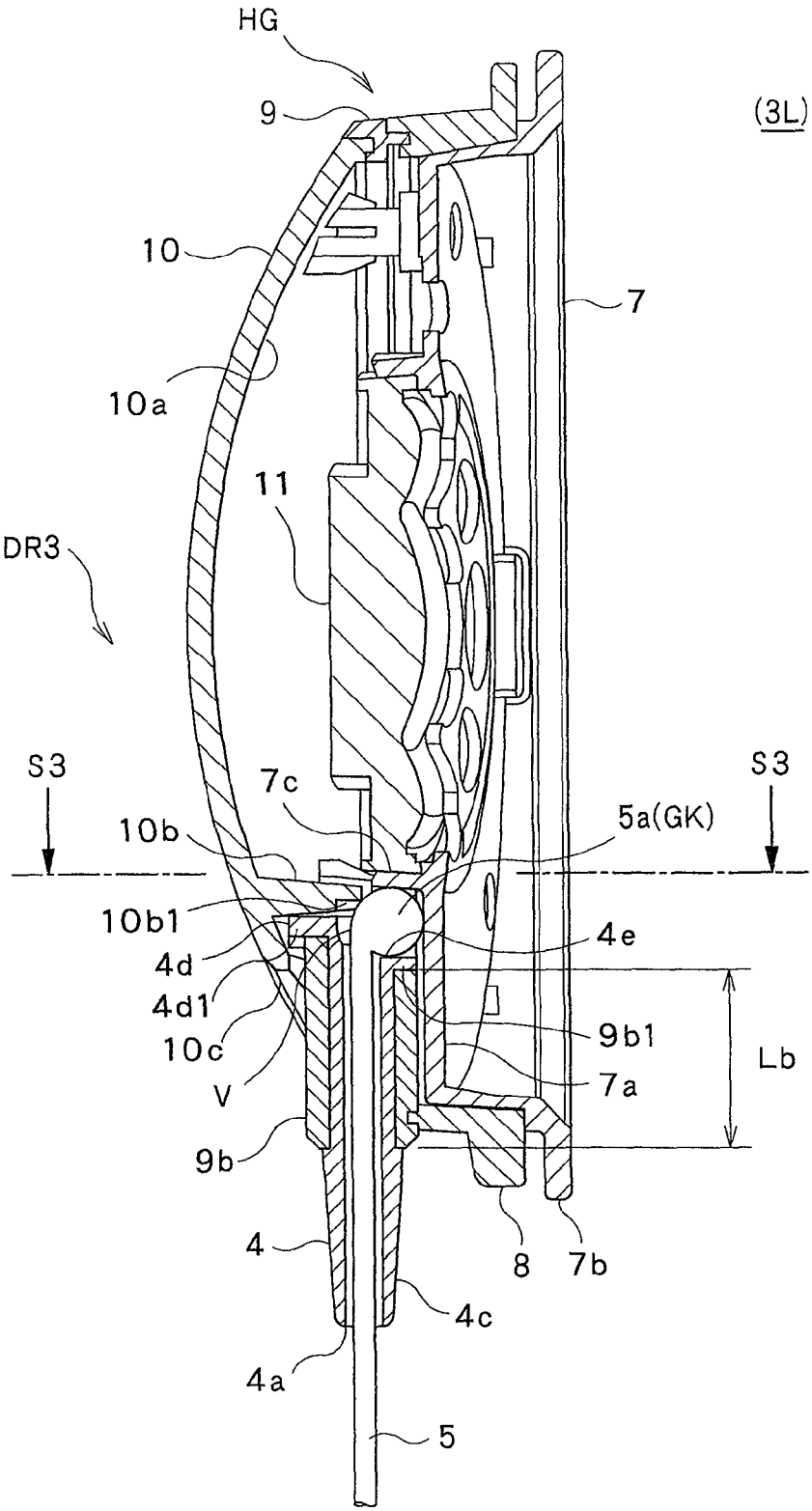
FIG. 7 is a sectional view of the main unit taken on line S2-S2 of FIG. 2.
Figure 9:
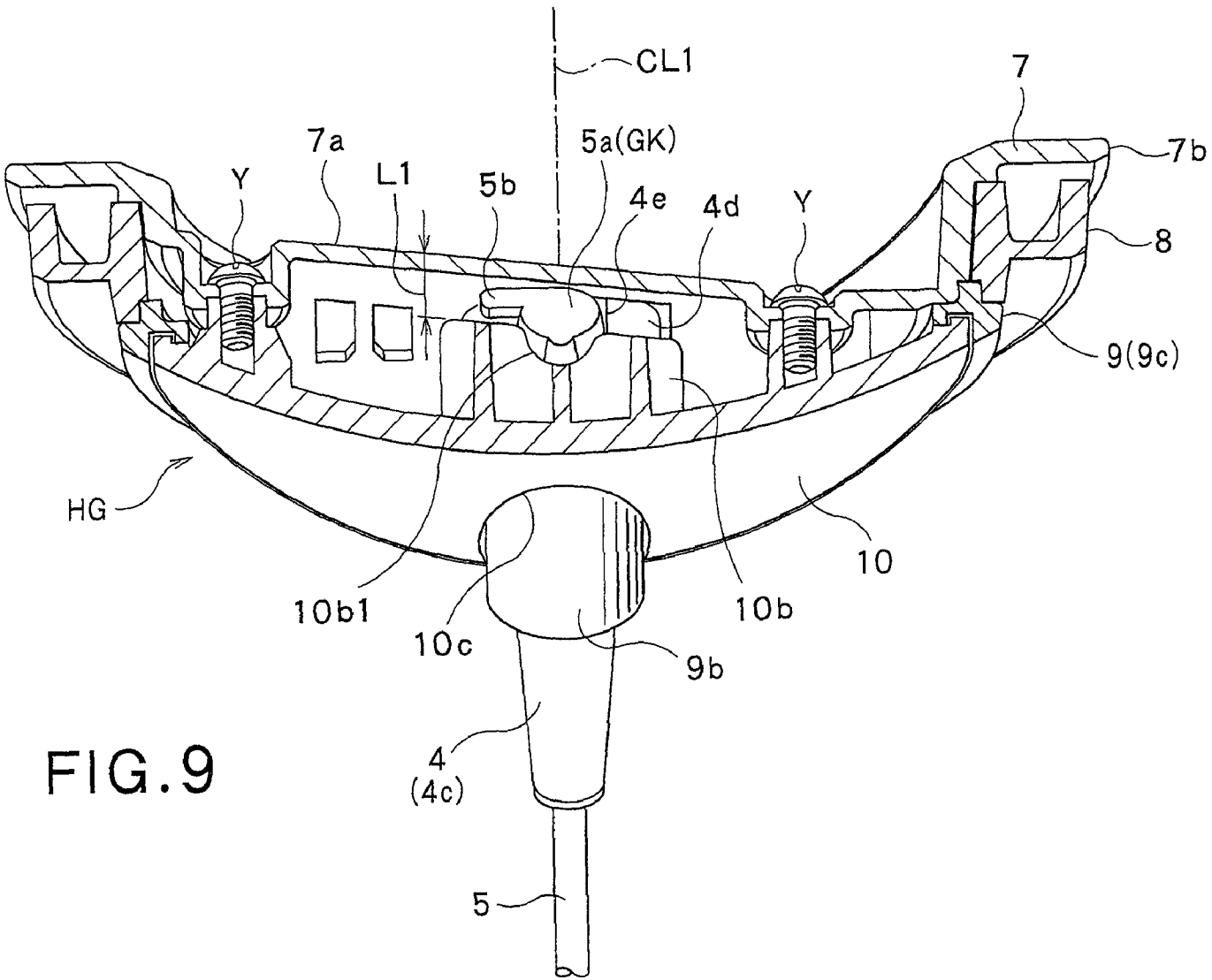
FIG. 9 is a perspective sectional view of the main unit taken on line S3-S3 of FIG. 7.

As shown in FIGS. 2, 7 and 9, the cover 10 is provided with a cutaway 10*c* along the longitudinal axis CL1. Through the cutaway 10*c*, a portion of tube 9*b* of the ornament ring 9 is exposed to the outside of the housing HG.

As shown in FIG. 9, the base 7 and the cover 10 are fixed to each other by a tapping screw Y, with the ring base 8 and the ornament ring 9 interposed therebetween. Shown in FIG. 9 are only two tapping screw Y, for brevity. Practically, the base 7 and the cover 10 are fixed to each other by three tapping screws Y, for example.

The housing HG has a roughly oval shape, as shown in FIGS. 1 and 2. Along the longitudinal axis CL1, a portion of the tube 9*b* of the ornament ring 9 is exposed to the outside of the housing HG. Moreover, the tapered tube 4*c* of the bushing 4 is exposed from the exposed tube 9*b*, with the cord 5 running outside along the longitudinal axis CL1.

The base 7, the ring base 8, the ornament ring 9, and the cover 10 are formed by resin molding using ABS (Acrylonitrile Butadiene Styrene) resin, for example. The ornament ring 9 is coated with chrome plating, for example. The bushing 4 is made of a flexible material, such as, silicon rubber.

Figure 4:
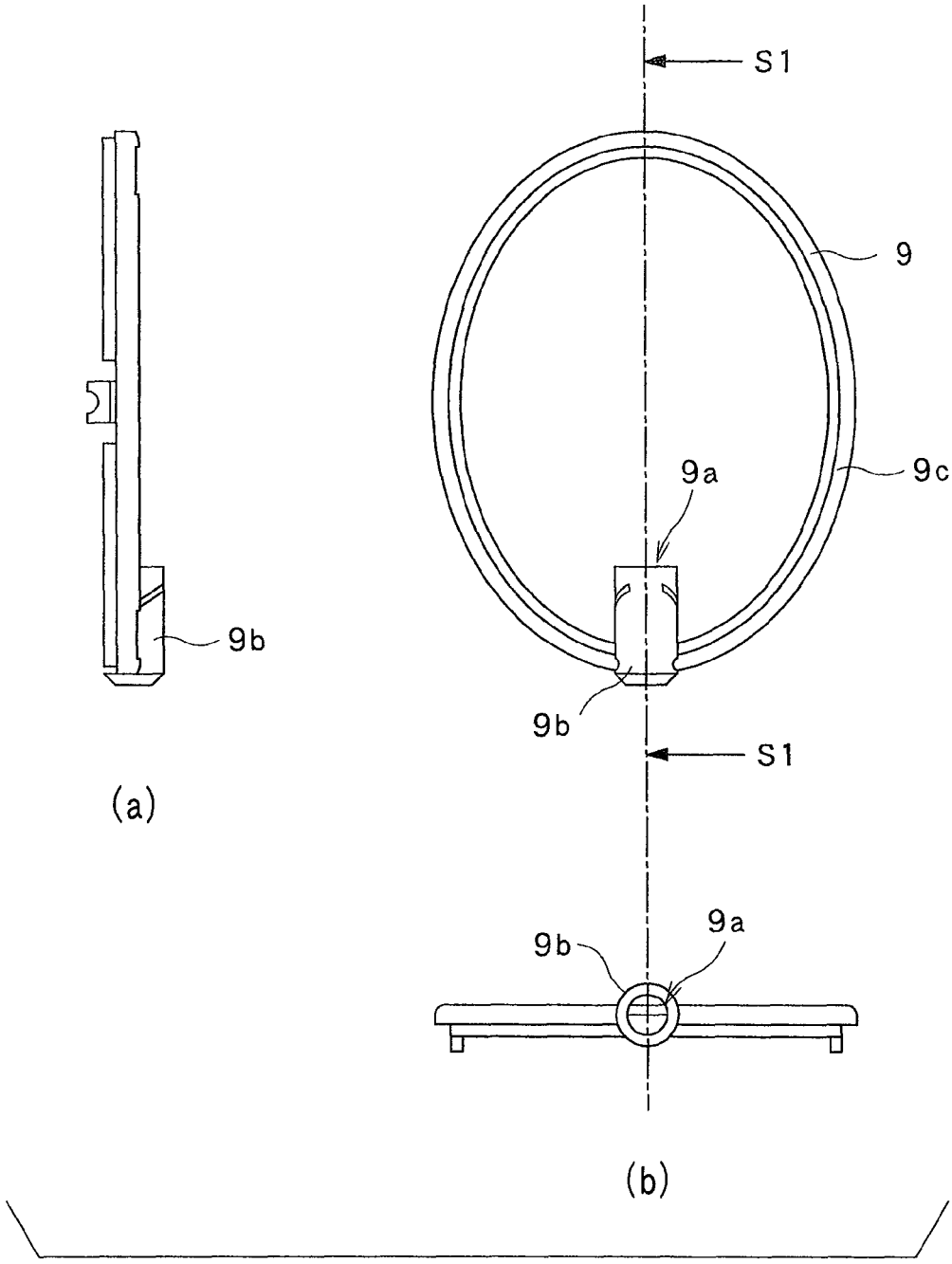
FIG. 4 is a three-view drawing that illustrates one component of the main unit.
Figure 6:
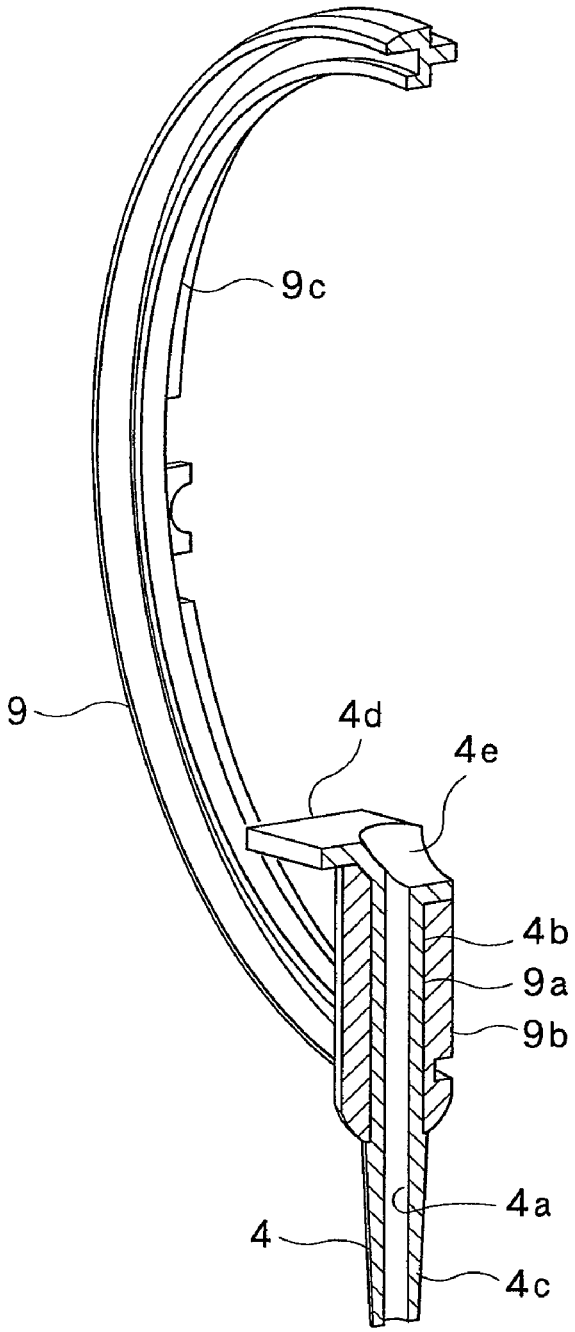
FIG. 6 is a perspective sectional view of an ornament ring taken on line S1-S1 of FIG. 4.

FIG. 6 is a perspective sectional view of the ornament ring 9 taken on line S1-S1 of FIG. 4. Illustrated in FIG. 6 is that the bushing 4 has been inserted into through hole 9*a* of the tube 9*b* of the ornament ring 9. The through hole 9*a* has an internal diameter roughly equal to or a little bit smaller than the outer diameter of the tube 4*b* of the bushing 4 so that bushing 4 can be tightly inserted into the through hole 9*a* with almost no gap.

The through hole 4*a* of the tube 4*b* of the bushing 4 has an internal diameter roughly equal to an outer diameter of the cord 5 so that the cord 5 can be tightly inserted into the through hole 4*a* with almost no gap.

Figure 8:
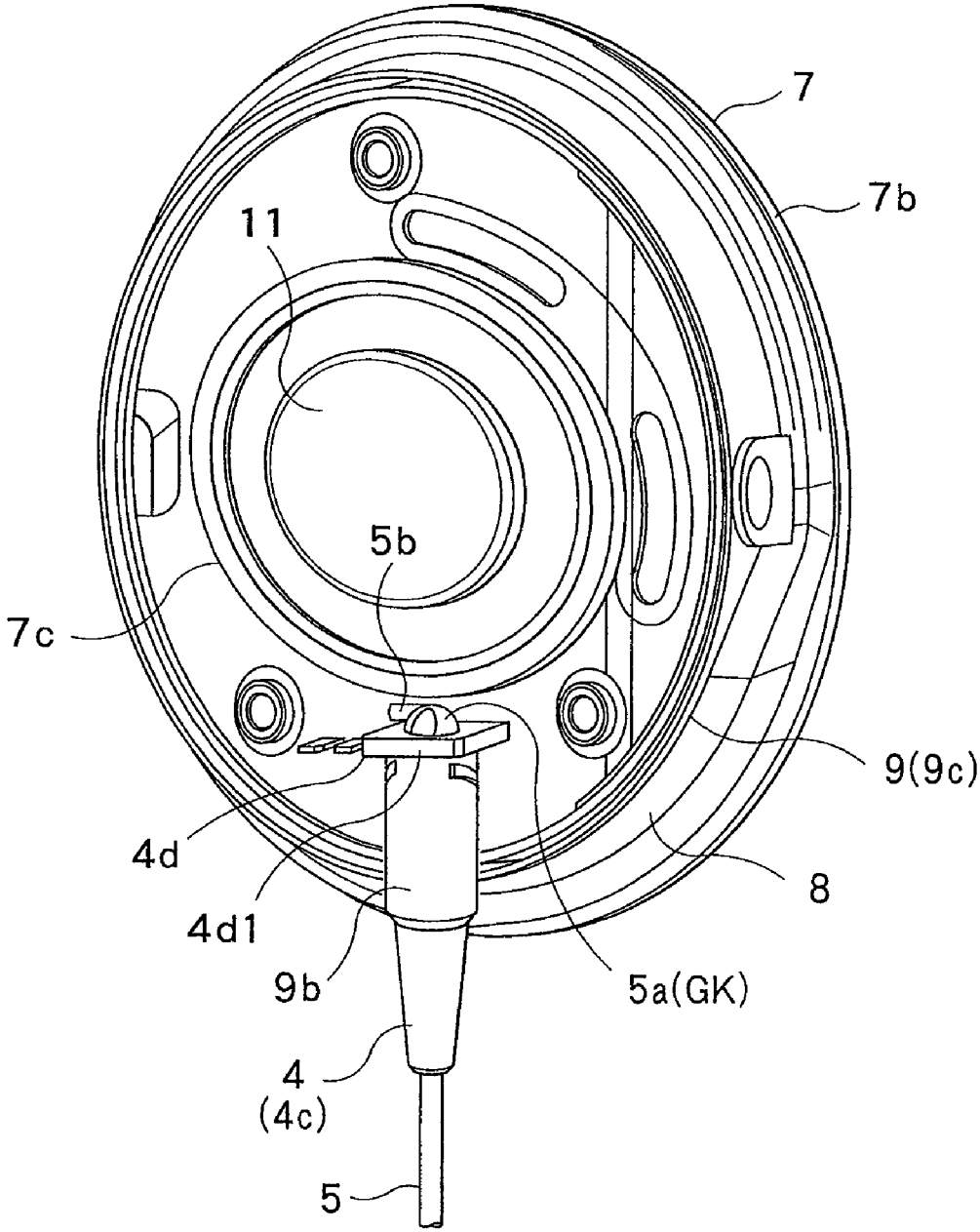
FIG. 8 is a perspective view of the main unit, without a cover.

Described next in detail with respect to FIGS. 7 to 9 is a configuration of the main unit 3L. FIG. 7 is a sectional view of the main unit taken on line S2-S2 of FIG. 2 (line S2-S2 corresponding to the longitudinal axis of the oval shape of the base 7). FIG. 8 is a perspective view of the main unit 3L, without the cover 10 (detached therefrom). FIG. 9 is a perspective sectional view of the main unit 3L taken on line S3-S3 of FIG. 7 and viewed from a direction of an arrow DR3.

As shown in FIG. 7, the tube 4*b* of the bushing 4 is covered with the tube 9*b* of the ornament ring 9 at least within a distance Lb in the longitudinal direction, with the tapered tube 4*c* exposed to the outside of the main unit 3L. An end of the tube 9*b* closer to the speaker unit 11 is in contact with the flange 4*d* of the bushing 4. The tube 9*b* is provided with a cutaway 9*b*1 (FIG. 3) at a location that corresponds to the concavity 4*e* of the bushing 4 when the end of the tube 9*b* is in contact with the flange 4*d*. The cutaway 9*b*1 is formed into a shape that does not cover the concavity 4*e*.

The bushing 4 is located so that its flange 4*d* becomes closer to the rib 7*c* of the base 7 with respect to the longitudinal axis CL1.

As shown in FIG. 9, the cover 10 is provided with a rib 10*b* on an inner surface 10*a* thereof at the portion where the cord 5 is running to the outside, so as to straddle the longitudinal axis CL1. Provided on top of the rib 10*b* and almost at the center of the rib 10*b* is a gouged section 10*b*1 that has a curved shape when viewed from above and in cross section.

In FIG. 7, provided between the bushing 4 and the speaker unit 11 is a space V that is surrounded by the baffle board 7*a*, the rib 7*c*, the concavity 4*e*, the cutaway 9*b*1, and the gouged section 10*b*1. Put in the space V is the outer-shape expansion portion GK (knot 5*a*) of the cord 5. And, at least a portion of the outer-shape expansion portion GK is installed in the concavity 4*e*.

As shown in FIG. 9, a gap L1 is provided between the top of the rib 7*c* and the baffle board 7*a*. From the gap L1, the cord end 5*b* is running toward the speaker unit 11. The cord end 5*b* is one end of the cord 5 closer to the speaker unit 11 than to the outer-shape expansion portion GK. The cord end 5*b* is shown for its portion only in FIG. 9.

The cord end 5*b* of the cord 5 is running from the outer-shape expansion portion GK in a direction other than the longitudinal axis CL1, almost orthogonal to the longitudinal axis CL1 in FIG. 9.

In the embodiment, the bushing 4 through which the cord 5 is running lies along the longitudinal axis CL1.

The position of the knot 5*a* (the outer-shape expansion portion GK) is restricted by the surrounding parts as follows:

The position of an end of the knot 5*a* closer to the speaker unit 11 is restricted by the rib 7*c* of the base 7. The position of the side face of the knot 5*a* is restricted by the gouged section 10*b*1 and the concavity 4*e*. The position of the other end of the knot 5*a* closer to the bushing 4 is restricted by the concavity 4*e*.

The flange 4*d* of the bushing 4 is formed into a rectangle, which is a quadrilateral in this embodiment. One of the four sides of the rectangular flange 4*d* is in contact with the baffle board 7*a* so that the bushing 4 is prevented from rotating about the longitudinal axis CL1. Provided on the one side is the concavity 4*e*.

As shown in FIG. 7, the rectangular flange 4*d* of the bushing 4 has one side 4*d*1 that faces the one side of flange 4*d* described above. The side 4*d*1 is tightly interposed between the tube 9*b* of the ornament ring 9 and a rib 10*b* of the tube 9*b* with almost no gap so that the position of the bushing 4 along the longitudinal axis CL1 is restricted. This configuration prevents the bushing 4 from being pulled out by pulling the tapered tube 4*c* and also from moving with respect to the ornament ring 9.

The tube 4*b* of the bushing 4 is covered with the tube 9*b* of the ornament ring 9 within the distance Lb in the longitudinal direction so that it cannot be bent within the distance Lb. The distance Lb is determined in accordance with the material of the bushing 4.

Since a portion of the bushing 4 is covered with the tube 9*b* as described above, it is extremely rare that the bushing 4 is bent and torn, even though the bushing 4 is provided with the concavity 4*e*.

Moreover, the tapered tube 4*c* of the bushing 4 is exposed from the tube 9*b* of the ornament ring 9 so that it is bendable. The bendable tapered tube 4*c* gives high durability to the cord 5.

In the embodiment, the flange 4*d* of the bushing 4 is provided with the concavity 4*e* to give the space V for the outer-shape expansion portion GK (the knot 5*a*). This configuration allows the flange 4*d* of the bushing 4 to be closer to the speaker unit 11.

The cord end 5*b* of the cord 5 is running from the outer-shape expansion portion GK (the knot 5*a*) in a direction other than the longitudinal axis CL1, for example, orthogonal to the longitudinal axis CL1 in FIG. 9.

The longitudinal axis CL1 agrees with the longitudinal axis of the through hole 4*a* of the bushing 4 in the embodiment.

If the housing HG is formed into a configuration without the longitudinal axis CL1, it is preferable that the cord end 5*b* of the cord 5 is running in a direction away from the longitudinal axis of the through hole 4*a* of the bushing 4.

With the configuration described above, a larger speaker unit can be installed in a main unit having the same size as that of the known headphones, or, conversely, a smaller main unit can install a speaker unit having the same size as that of the known headphones.

In the embodiment, a portion of the tube 9*b* of the ornament ring 9 is exposed to the outside from the cover 10 so that the flange 4*d* of the bushing 4 is located closer to the inner periphery of the main unit 3L. This arrangement decreases the volume of the bushing 4 in the main unit 3L.

The decreased volume of the bushing in the main unit allows a larger speaker unit to be installed in a main unit having the same size as that of the known headphones, or, conversely, a smaller main unit to install a speaker unit having the same size as that of the known headphones.

Moreover, a larger internal spatial volume (a back cavity) can be given to the main unit even if the main unit and the speaker unit of the embodiment are formed to have the same size as those of the known headphones. Therefore, the headphone set 50 of the embodiment can reproduce sounds of a rich low tone.

The bushing 4 is made of a flexible material, such as, silicon rubber, and hence a user can enjoy its flexibility and softness.

Suppose that the headphone set 50 is configured to have the bushing 4 exposed to the outside of the housing HG not through the tube 9*b* of the ornament ring 9. In this case, there are many restrictions on design for a user so as not to feel the difference in material between the rubber of the bushing 4 and the resin of the cover 10 and other parts of the housing HG.

However, in this embodiment, the bushing 4 is exposed to the outside of the housing HG through the tube 9*b* of the ornament ring 9. Therefore, the color or coating of the ornament ring 9 can be changed freely so that a user does not feel the difference in material, which increases flexibility in design for the appearance of the headphone set 50.

It is further understood by those skilled in the art that the foregoing description is a preferred embodiment of the disclosed apparatus and that various changes and modifications may be made in the invention without departing from the sprit and scope thereof.

For example, the bushing 4 and the cord 5 may be running from the main units 3L and 3R in any direction that does not lie along the longitudinal axes of the main units 3L and 3R.

The headphone set 50 of the embodiment is an overhead type, equipped with the head band 1. Not only that, the present invention is applicable to an inner-ear type to be inserted into the auricle.

The tube 9*b* that supports the bushing 4 is not always necessary one of the parts of the ornament ring 9.

The outer-shape expansion portion GK of the cord 5 is not always necessary the knot 5*a* tied in the cord 5. It may be a protrusion formed by thermal welding or formed integral with the cord 5. The shape of the protrusion may be a rectangle, a polygon, a circle, a semi-circle sphere, and any other shape which has no particular name, when viewed from above.

As described above in detail, the present invention provides a headphone set equipped with a compact housing having an outer-shape expansion portion of a cord and a bushing for the cord, that exhibits high durability.

What is claimed is:

1. A headphone set comprising:

a housing formed of a base and a cover, the housing having a pulling-out portion provided between the base and the cover;

a speaker enclosed in the housing and covered with the cover;

a first rib standing on the base and surrounding the speaker;

a cord having a first end and an opposing second end, the first end being connected to the speaker, the second end being running to the outside of the housing through the pulling-out portion;

a bushing formed into a tube having a first through hole, the bushing supporting the cord in a way that the cord is inserted into the first through hole at the pulling-out portion;

an outer-shape expansion portion fixed to the cord and expanding the outer shape of the cord; and a concavity provided to the bushing at one end of the bushing closer to the speaker, at least a portion of the outer-shape expansion portion being put in the concavity, wherein the outer-shape expansion portion is provided between the first rib and the concavity.

2. The headphone set according to claim 1 wherein the pulling-out portion has a tube having a second through hole, a portion of the bushing closer to the speaker being inserted into the second through hole.

3. The headphone set according to claim 1 wherein the speaker is located in a way that at least a portion of the speaker lies along an axis of the first through hole of the bushing with respect to the outer-shape expansion portion, the first end of the cord is running in a direction different from the axis of the first through hole.

4. The headphone set according to claim 1 further comprising a second rib standing on the cover towards the base wherein the outer-shape expansion portion is provided among the first rib, the second rib and the concavity so that a position of a third end of the outer-shape expansion portion closer to the speaker is restricted by the first rib, a position of a fourth end of the outer-shape expansion portion closer to the bushing is restricted by the concavity, and a position of a fifth end of the outershape expansion portion is restricted by the second rib, the third end being positioned between the first and second ends.

* * * * *